US011203893B2

(12) United States Patent
Soderqvist

(10) Patent No.: US 11,203,893 B2
(45) Date of Patent: Dec. 21, 2021

(54) SWING DOOR OPERATOR

(71) Applicant: ASSA ABLOY ENTRANCE SYSTEMS AB, Landskrona (SE)

(72) Inventor: Sven-Gunnar Soderqvist, Vallakra (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 163 days.

(21) Appl. No.: 16/605,737

(22) PCT Filed: Apr. 23, 2018

(86) PCT No.: PCT/EP2018/060256
§ 371 (c)(1),
(2) Date: Oct. 16, 2019

(87) PCT Pub. No.: WO2018/197367
PCT Pub. Date: Nov. 1, 2018

(65) Prior Publication Data

US 2021/0123285 A1 Apr. 29, 2021

(30) Foreign Application Priority Data

Apr. 24, 2017 (SE) ..... 1730112-8

(51) Int. Cl.
*E05F 15/02* (2006.01)
*E05F 15/63* (2015.01)
*E05F 15/72* (2015.01)

(52) U.S. Cl.
CPC ..... *E05F 15/63* (2015.01); *E05F 15/72* (2015.01); *E05Y 2201/422* (2013.01);
(Continued)

(58) Field of Classification Search
CPC .... E05F 15/63; E05F 15/72; E05Y 2201/422; E05Y 2201/624; E05Y 2600/452; E05Y 2900/134
(Continued)

(56) References Cited

U.S. PATENT DOCUMENTS 1,716,707 A * 6/1929 Schoelkopf ..... E05F 15/53 49/138
3,344,555 A * 10/1967 Hugle ..... E05F 15/53 49/340
(Continued)

FOREIGN PATENT DOCUMENTS

CN 2594424 12/2003
DE 19500945 2/1996
(Continued)

OTHER PUBLICATIONS

International Search Report and Written Opinion mailed in PCT/EP2018/060256 dated Aug. 6, 2018.
Swedish Search Report mailed in 1730112-8 dated Nov. 24, 2017.

*Primary Examiner* — Jerry E Redman
(74) *Attorney, Agent, or Firm* — Wissing Miller LLP

(57) ABSTRACT

The present invention relates to a fire swing door operator system (100) comprising at least one swing door operator (1), a wall (200), a door frame (300), and at least one swing door leaf (400), wherein the door frame (300) is mounted in an opening in the wall, the at least one swing door leaf (400) is hingedly connected to the door frame (300), the wall (200) comprise a first wall section (201) at one side of the door frame (300) and a second wall section (202) at the other side of the door frame (300), the swing door operator (1) is mounted to the first wall section (201) and connected to the at least one swing door leaf (400) and arranged to move the at least one swing door leaf (400) between a closed and an open position.

18 Claims, 4 Drawing Sheets

(52) U.S. Cl.
CPC ... *E05Y 2201/624* (2013.01); *E05Y 2600/452* (2013.01); *E05Y 2900/134* (2013.01)

(58) Field of Classification Search
USPC ..... 49/339, 340, 341, 345, 346
See application file for complete search history.

(56) References Cited

U.S. PATENT DOCUMENTS

| | | | | | |
|---|---|---|---|---|---|
| 3,874,117 | A * | 4/1975 | Boehm | E05F 15/63 | 49/264 |
| 4,367,610 | A * | 1/1983 | Goode | E05F 15/53 | 49/336 |
| 4,429,491 | A * | 2/1984 | Bruns | E05F 15/53 | 49/340 |
| 4,598,494 | A * | 7/1986 | Tsuji | A62C 2/247 | 16/48.5 |
| 4,625,455 | A * | 12/1986 | Harris | E05F 15/63 | 49/281 |
| 4,638,597 | A * | 1/1987 | Lybecker | E05F 15/53 | 49/340 |
| 4,727,679 | A * | 3/1988 | Kornbrekke | E05F 15/63 | 49/138 |
| 6,067,753 | A * | 5/2000 | Hebda | E05F 15/63 | 49/28 |
| 6,177,771 | B1 * | 1/2001 | Kinzer | G05B 19/291 | 318/280 |
| 6,481,160 | B1 * | 11/2002 | Kowalczyk | E05F 3/224 | 49/333 |
| 6,742,303 | B2 * | 6/2004 | Pedemonte | E05F 15/622 | 49/339 |
| 6,751,909 | B2 * | 6/2004 | Ranaudo | G05B 19/042 | 49/334 |
| 7,665,930 | B2 * | 2/2010 | Kennedy | E21F 1/10 | 405/144 |
| 8,341,889 | B2 * | 1/2013 | Faulkner | E05F 15/603 | 49/345 |
| 2002/0022526 | A1 * | 2/2002 | Baker | E05F 15/63 | 464/29 |
| 2004/0261319 | A1 * | 12/2004 | Kennedy | F15B 11/076 | 49/339 |
| 2005/0073425 | A1 * | 4/2005 | Snell | E05F 15/73 | 340/686.6 |
| 2007/0256362 | A1 * | 11/2007 | Hansen | E05F 15/63 | 49/32 |
| 2009/0320375 | A1 * | 12/2009 | Treihaft | E05F 15/63 | 49/360 |
| 2012/0227324 | A1 * | 9/2012 | Kristerson | E05B 81/10 | 49/141 |
| 2012/0317883 | A1 * | 12/2012 | Yamaguchi | E05F 3/106 | 49/358 |
| 2015/0128496 | A1 * | 5/2015 | Phillips | E05B 65/10 | 49/13 |
| 2016/0325817 | A1 * | 11/2016 | Buttelmann | B64C 1/1469 | |
| 2017/0275938 | A1 * | 9/2017 | Langenberg | E05F 15/70 | |
| 2018/0298664 | A1 * | 10/2018 | Sauter | E05F 15/63 | |
| 2019/0093407 | A1 * | 3/2019 | Lygin | E05F 15/63 | |
| 2019/0292835 | A1 * | 9/2019 | Soderqvist | E05F 15/63 | |
| 2020/0224479 | A1 * | 7/2020 | Vetter | E05F 1/10 | |
| 2020/0300026 | A1 * | 9/2020 | Lawhon | G05B 19/0426 | |
| 2020/0340280 | A1 * | 10/2020 | Oakley | E05F 3/227 | |
| 2020/0355007 | A1 * | 11/2020 | Aceto | E05F 15/603 | |

FOREIGN PATENT DOCUMENTS

| | | | | |
|---|---|---|---|---|
| DE | 10200703076 | | 7/2008 | |
| DE | 202015003728 | | 6/2015 | |
| FR | 2633003 | | 12/1989 | |
| FR | 2701732 | | 8/1994 | |
| FR | 2834529 | | 7/2003 | |
| GB | 2214566 | | 9/1989 | |
| SE | 7512412 | | 5/1977 | |
| SE | 8005468 | | 1/1982 | |
| SE | 8005827 | | 2/1982 | |
| SE | 8100121 | | 7/1982 | |
| WO | WO-2019230114 | A1 * | 12/2019 | E05F 15/00 |

* cited by examiner

SWING DOOR OPERATOR

This application is a 371 of PCT/EP2018/060256 filed on Apr. 23, 2018, published on Nov. 1, 2018 under publication number WO 2018/197367, which claims priority benefits from Swedish Patent Application No. 1730112-8 filed on Apr. 24, 2017, the disclosure of which is incorporated herein by reference.

FIELD OF THE INVENTION

The present invention relates to a fire door operator system.

BACKGROUND OF THE INVENTION

Automatic door sets are regulated by standards which define requirements on how a door operator should function in different situations, including pedestrian protection requirements for door sets. These regulations define, e.g., maximum kinetic energy, maximum closing force, opening and closing time, and use of safety sensors.

These regulations were also created in order assure that a fire door closes in a correct manner in case of an emergency. Further, to fulfil these requirements the door operators need to be very robust and to be able to close or open a fire door even in an unpowered state. However, the space for mounting a fire swing door operator is often reduced as the architects would like to increase the size of the door openings or to other constructual requirements. There is thus a need for that a fire swing door operator could be used to open or close a fire door in the event of an emergency and at the same time allow the door opening to be as large as possible.

SUMMARY OF THE INVENTION

It is an object of the present invention to mitigate the above problems, and to provide a solution that allows a swing door operator to be used in a fire swing door operator system even if the area above the door frame and the door leaf is limited or even none. According to a first aspect of the present invention, these objects are achieved by a fire swing door operator system comprising at least one swing door operator, a wall, a door frame, and at least one swing door leaf, wherein the door frame is mounted in an opening in the wall, the at least one swing door leaf is hingedly connected to the door frame, the wall comprise a first wall section at one side of the door frame and a second wall section at the other side of the door frame, the swing door operator is mounted to the first wall section and connected to the at least one swing door leaf and arranged to move the at least one swing door leaf between a closed and an open position.

Such a solution allows for a safe and rapid closing or opening of a fire door by using a swing door operator even if the area above the door frame not is enough to mount a swing door operator above the door. Further, this solution does not require any significant rebuilding or redesigning of existing areas where one would like to use a fire swing door operator system. By arranging the swing door operator on the first wall section a swing door operator could be used that not need to occupy any space above the door frame. The swing door operator could be used together with door frames that run all the way up to the ceiling or very close to the ceiling.

According to an aspect the swing door operator comprise a drive unit comprising at least one motor and at least one spring, wherein the motor and the spring is arranged to interact to move the at least one swing door leaf. By having a mechanical and an electrical drive source, the swing door operator secures that it will be able to drive the swing door leaf in case of an emergency.

According to an aspect the swing door operator comprise an axle and an arm system, the axle is connected to the drive unit and to the arm system and the arm system is further connected to the at least one swing door leaf, wherein the axle and the arm system is arranged to interact with the drive unit to move said at least one swing door leaf.

According to an aspect the axle extends upwards from the drive unit. By having the axle extending upwards the free height for passing through the door without the risk of get into contact with the moving arm system could be increases even if the swing door operator is mounted at a height that is low.

According to an aspect the at least one motor and at least one spring is positioned on the same side of the axle in the swing door operator, which involves that the axle could be positioned on one side of the swing door operator and thus be positioned closer to the hinge of the swing door leaf.

According to an aspect the axle is positioned closer to the door frame than the at least one motor and at least one spring. This reduces the distance between the axle and the door frame that in turn reduces the forces needed to open and close the swing door leaf.

According to an aspect the at least one spring is arranged around the axle.

According to an aspect the swing door operator is arranged to push the at least one swing door leaf from its closed position to its open position.

According to an aspect the swing door operator is arranged to pull the at least one swing door leaf from its closed position to its open position.

According to an aspect the first wall section is angled in view of the at least one swing door leaf in its closed position.

According to an aspect the first and second wall sections are wall sections on separate sides of a corridor.

According to an aspect the first and second wall sections are wall sections on separate sides of a corner.

According to an aspect the first wall section is parallel with the at least one swing door leaf in its closed position.

According to an aspect the fire swing door operator system further comprise a second swing door operator and a second swing door leaf connected to the door frame, wherein the second swing door operator is mounted to the second wall section and connected to the second swing door leaf and arranged to move the second swing door leaf between a closed and an open position.

According to an aspect the swing door operator further comprise a control unit connected to the drive unit and arranged to control the movement of the drive unit.

According to an aspect the at least one door operator are mounted at a height on the first and/or second wall section that is equal to or lower than the height of the door frame.

According to an aspect the at least one door operator are mounted at a height on the first and/or second wall section that is equal to or lower than the height of the swing door leaf.

According to an aspect the door frame comprise two vertical elements and a horizontal element connecting the two vertical elements and the at least one swing door leaf is hingedly connected to one of the vertical elements.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Aspects of the present disclosure will be described more fully hereinafter with reference to the accompanying figures. The assembly disclosed herein can, however, be realized in many different forms and should not be construed as being limited to the aspects set forth herein.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operator systems for different types of doors, door sets and door leafs. More specifically, the invention relates to a fire swing door operator systems for any type of door leafs.

The present invention relates to a door operator for different types of doors, door sets and door leafs. More specifically, the invention relates to door operators for swing door sets.

According to an aspect, a door operator system comprises one or more door operators connected to one or more swing door leafs.

Figure 2:
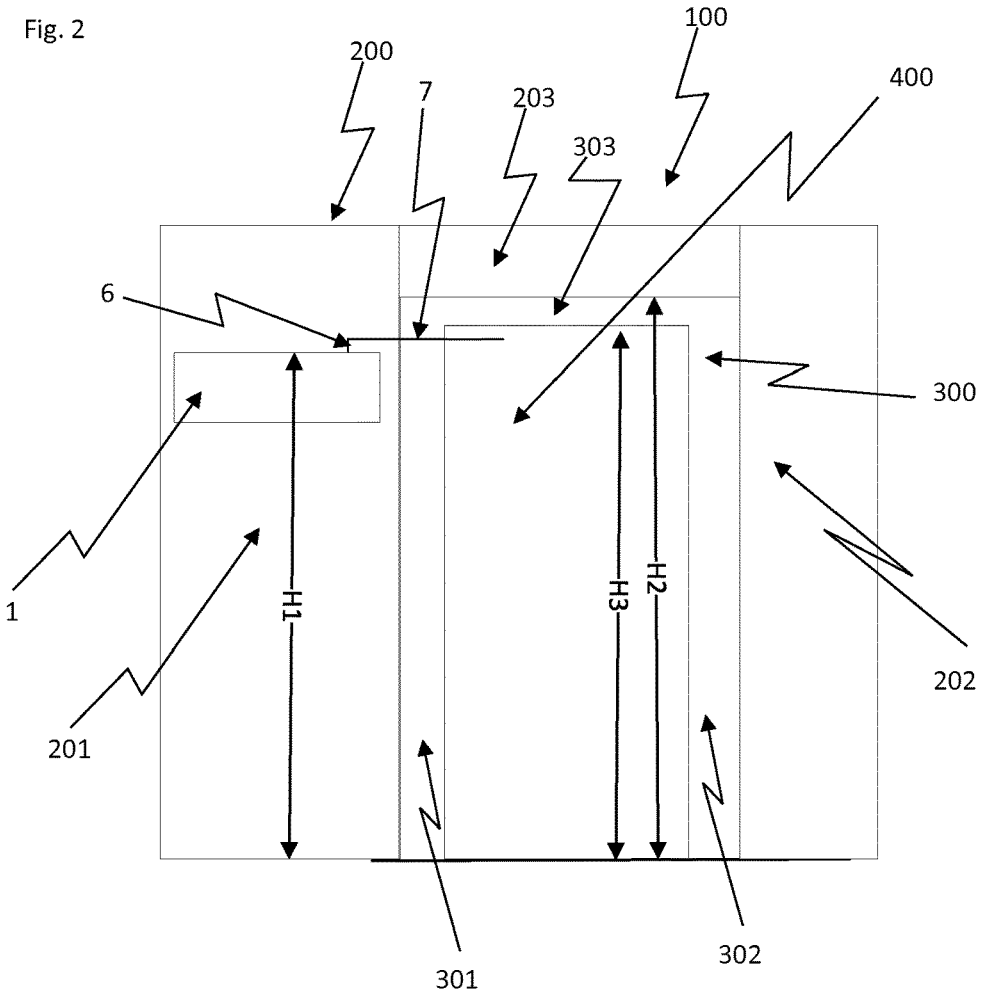
FIG. 2 shows a schematic view of a fire swing door operator system comprising one door leaf and one swing door operator according to an aspect of the present invention.
Figure 3:
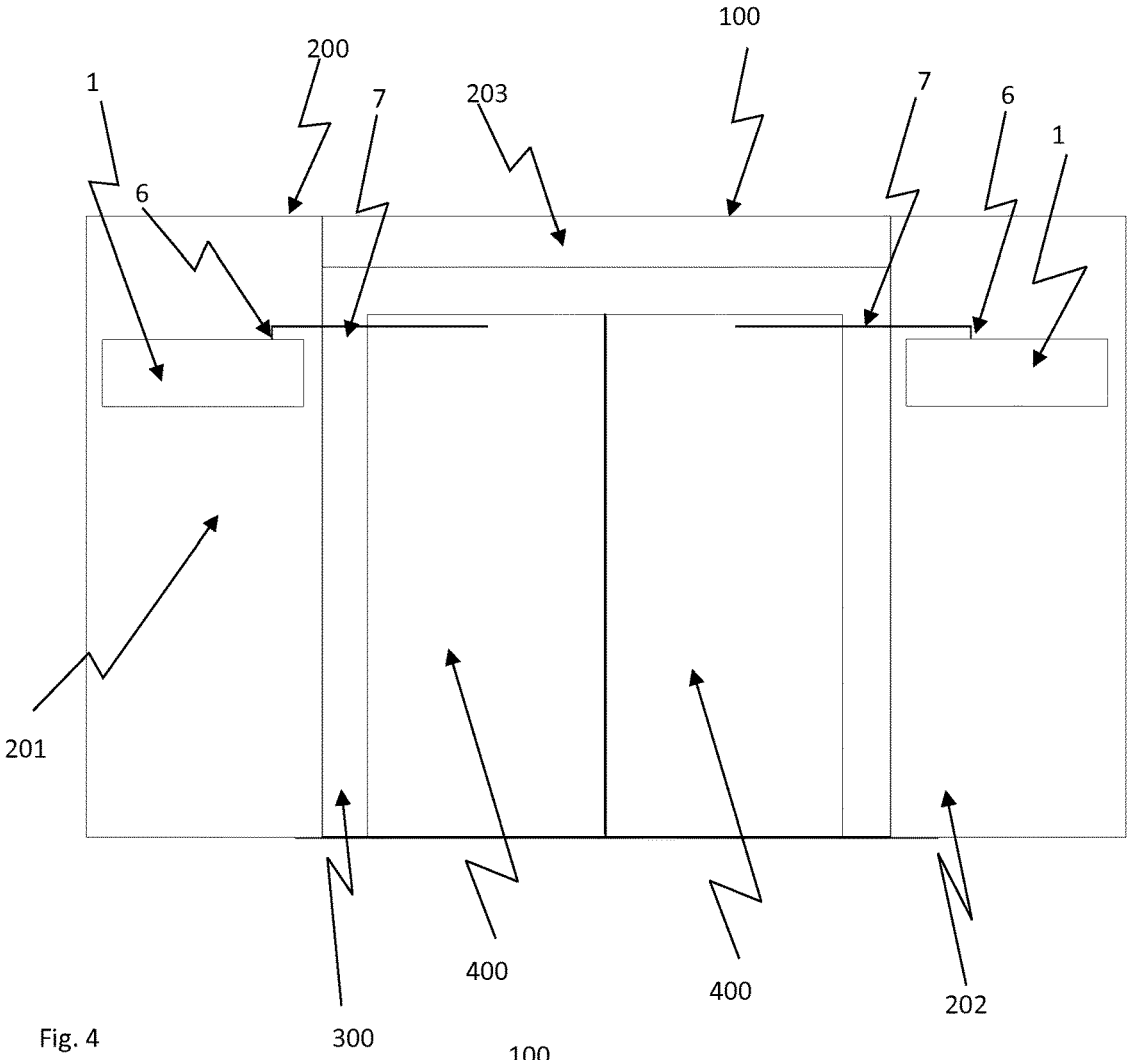
FIG. 3 shows a schematic view of a fire swing door operator system comprising two door leafs and two swing door operators according to an aspect of the present invention.

In FIGS. 2 and 3 a fire swing door operator system 100 is disclosed according to an aspect of the invention. The fire swing door operator system 100 comprises a swing door operator 1, a wall 200, a door frame 300 and a swing door leaf 400. A fire swing door operator system 100 is located in buildings to be a part of a system to restrict the effect of a fire in an emergency situation. The system should work in an emergency situation even if there is a power outage and the system should be able to either close a swing door leaf 400 to close a fire cell or to open a swing door leaf 400 to keep an escape route open.

A fire swing door operator system 100 generally refers to a system having one or two swing door leafs 400, i.e. a single leaf swing door operator system 100, as disclosed in FIG. 2, 4-7 or a double leaf swing door operator system 100 as disclosed in FIG. 3, where each swing door leaf is hingedly or pivoted to the door frame 300 via a hinge 401 at one of its edges. Each swing door leaf 400 has a main opening/closing edge, arranged opposite to the hinge/pivot edge. In other words, the main opening/closing edge refers to the edge of a swing door leaf 400 whose distance from a parallel, opposing edge or surface determines the usable opening of the swing door leafs 400. The opposing opening/closing edge refers to either an edge formed by the main opening/closing edge of a counter closing swing door leaf, or a fixed edge or a surface towards which the swing door leaf 400 is moving, such as the door frame 300.

When the fire swing door operator system 100 is provided with only one swing door leaf 400, the swing door leaf 400 is hingedly or pivoted at one edge to the door frame 300, while the main opening/closing edge of the swing door leaf 400 closes against, and preferably locks with, the corresponding edge of the door frame 300.

When the fire swing door operator system 100 is provided with two swing door leafs 400, the fire swing door operator system 100 may comprise two identical swing door leafs 400, arranged side by side with their respective opening/closing edges in close proximity to each other when both door leafs 400 are in the closed position.

Also, the swing door operator system 100 may comprise a master swing door leaf 400, provided with a flange extending along its main opening/closing edge, and a slave swing door leaf 400. The flange of the master swing door leaf 400 is adapted to protrude over the main opening/closing edge of the slave swing door leaf 400, when both swing door leafs 400 are in the closed position. With such an arrangement, the swing door leafs 400 can be pushed open in one direction only, preferably from the inside of a room or building in a direction outwards towards the exterior, a corridor, or an evacuation route. The main opening/closing edge of the master swing door leaf 400 closes against, and preferably locks into, an opposing opening/closing edge, i.e. the main opening/closing edge, of the slave swing door leaf 400.

Figure 1:
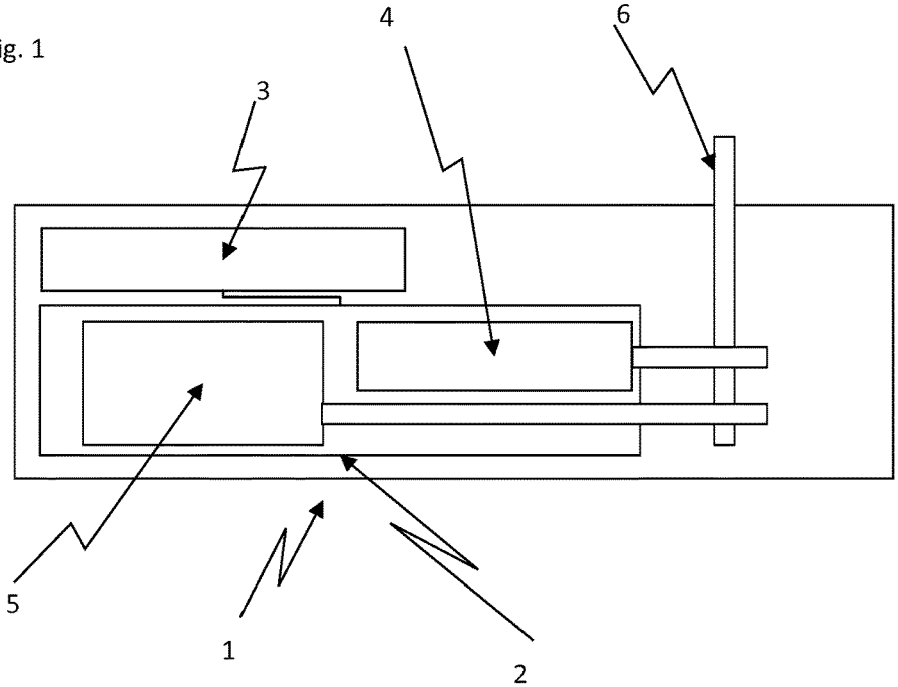
FIG. 1 shows a schematic view of a swing door operator according to an aspect of the present invention.

The swing door operator 1 as disclosed in FIG. 1 comprises a drive unit 2, a control unit 3, an axle 6 and an arm system 7. The swing door operator 1 can also comprise further components, such as a battery (not disclosed) and different sensors (not disclosed). These components as such are known in the art and will not be described in detail herein.

The drive unit 2 is connected to the control unit 3. The drive unit 2 comprise a spring 4 and a motor 5. The drive unit 2 could further comprise a gearbox (not disclosed). The drive unit 2 is adapted to be connected to a swing door leaf 400 via the axle 6 and the arm system 7 and to move the swing door leaf 400 between an open and closed position, i.e. from an open position to a closed position and from a closed position to an open position. The motor 5 and the spring 4 are connected to the axle 6. The motor 5 and the spring 4 are arranged to interact to rotate the axle 6. The spring 4 is according to an aspect a torsion spring 4. The spring 4 is according to an aspect a clock spring. According to an aspect the spring 4 is a compressor spring that interacts with a cam mechanism. According to one aspect the spring 4 is winded around the axle 6. According to an aspect the axle 6 is connected to the drive unit 2 and extends upwards from the drive unit 2. According to an aspect the axle 6 is connected to the drive unit 2 and extends downwards from the drive unit 2. According to an aspect the axle 6 is positioned at one side of the drive unit 2. According to an aspect the axle 6 is positioned on one side of the motor 5 and the spring 4.

The spring 4 are moved by the motor 5 when it is moving the swing door leaf 400 in one direction and the motor 5 and the spring 4 together moves the swing door leaf 400 in the opposite direction. In this way the spring 4 always have stored energy to move the swing door leaf 400 back to a starting position. This position could either be the open position or the closed position.

The axle 6 is in one end connected to the drive unit 2. The axle 6 is connected to both the motor 5 and the spring 4. The axle 6 is in the other end connected to the arm system 7. When the axle 6 is rotated by the drive unit 2 it also rotates the arm system 7. According to an aspect the swing door operator is mounted to the wall such that the axle 6 is positioned as close as possible to the swing door leaf 400.

According to an aspect the swing door operator 1 is arranged to close the swing door leaf 400 in case of an emergency. In such an arrangement the spring 4 is tensioned and arranged to store energy when the swing door leaf 400 is moved from the closed position to the open position by the motor 5. In this way the spring 4 always have the energy to move the swing door leaf 400 from the open position to the closed position, even if the power to the motor 5 is cut.

According to an aspect the swing door operator 1 is arranged to open the swing door leaf 400 in case of an emergency. In such an arrangement the spring 4 is tensioned and arranged to store energy when the swing door leaf 400 is moved from the open position to the closed position by the motor 5. In this way the spring 4 always have the energy to move the swing door leaf 400 from the closed position to the open position, even if the power to the motor 5 is cut.

The control unit 3 controls when the drive unit 2 should move the swing door leaf 400 between the open and closed position and how it should move it. The speed trajectory that the control unit 3 controls the drive unit 2 to move the swing door leaf 400 along comprise information of one or more of which speed the swing door leaf 400 should be moved, acceleration, braking, the opening time, for how long the door should be open and/or the closing speed etc. The control unit 3 is arranged to store different speed trajectories and control the drive unit 2 to move the swing door leaf 400 along different trajectories. According to an aspect the drive unit 3 is arranged to apply different trajectories based on how the swing door operator 1 is mounted in relation to the swing door leaf 400, if it is mounted to apply a pull or push application and the geometrically dimensions of the swing door leaf 400. The control unit 3 is according to some aspects connected to different sensors and systems and arranged to control the drive unit 2 based on received information from the sensors and systems. According to an aspect the control unit 3 is connected to an alarm system. According to an aspect the control unit 3 is connected to a fire alarm system.

Figure 4:
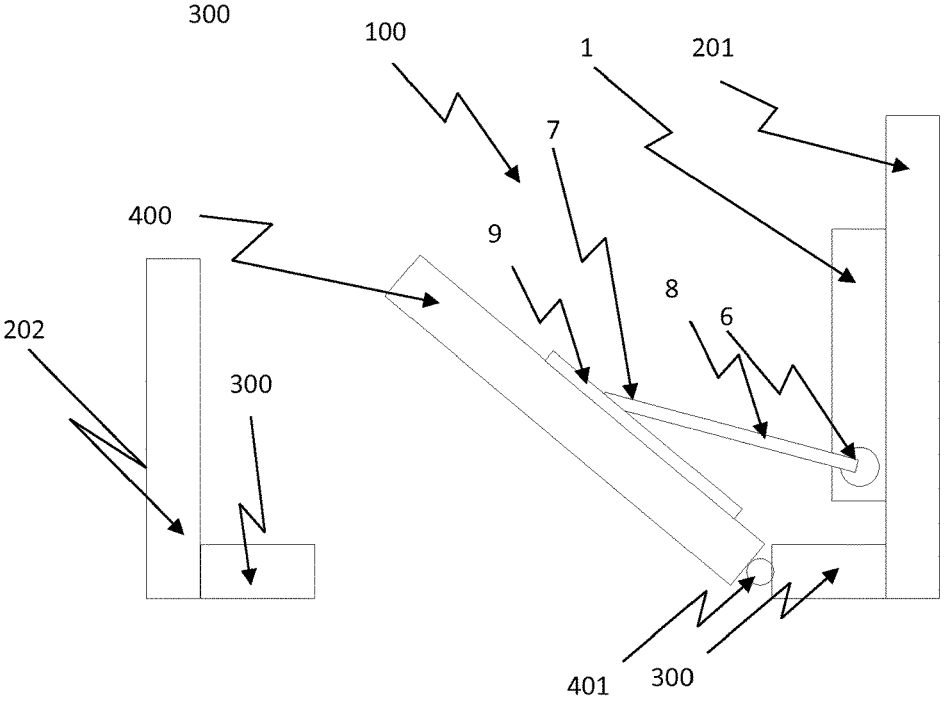
FIG. 4 shows a schematic top view of a fire swing door operator system comprising one corridor mounted swing door operator for pull application connected to a swing door leaf according to an aspect of the invention.
Figure 7:
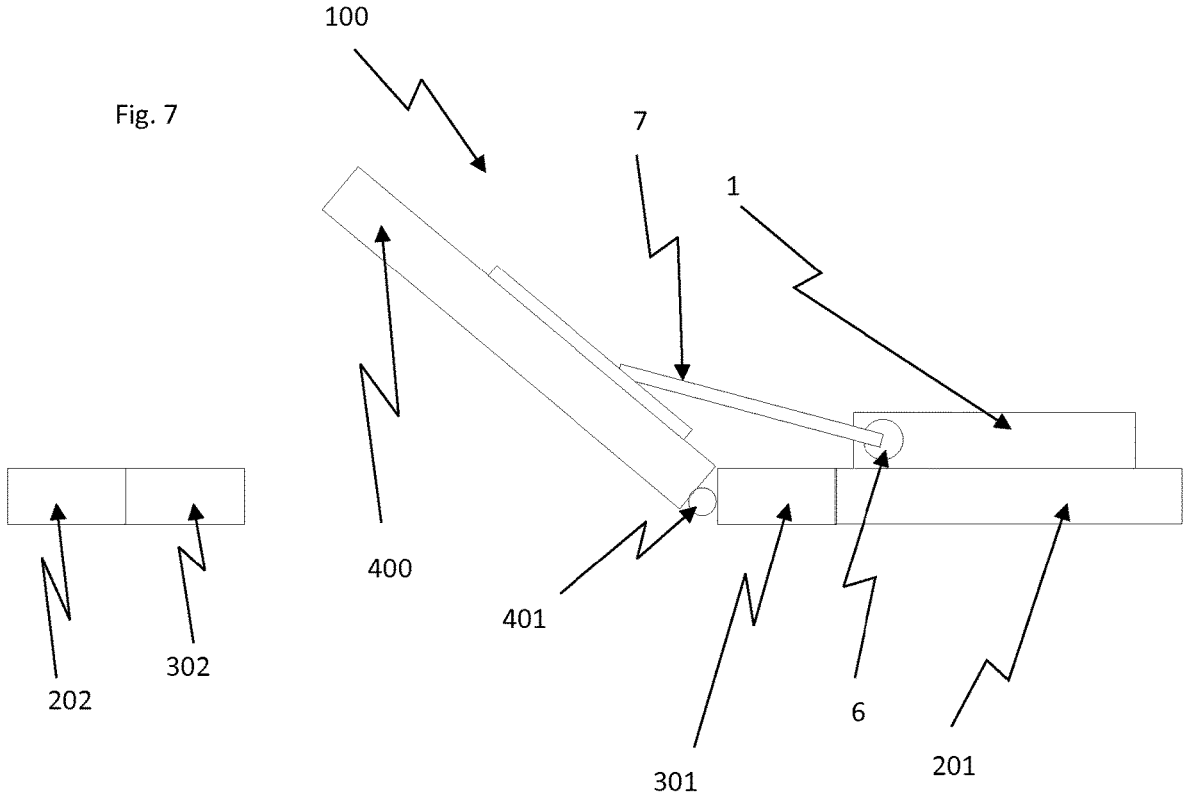
FIG. 7 shows a schematic top view of a fire swing door operator system comprising one side mounted swing door operator for pull application connected to a swing door leaf according to an aspect of the invention.

The arm system 7 is according to an aspect a pull arm system 7, as disclosed in FIGS. 4 and 7. The arm system is in one end connected to the axle 6. The arm system 7 is in its other end connected to the swing door leaf 400. The pull arm system 7 comprises an arm 8 and an arm guide 9. The arm 8 is in one end connected to the axle 6. The arm 8 is in the other end slideably connected to the arm guide 9. The arm guide 9 is mounted to the swing door leaf 400. When the axle 6 is rotated the arm 8 rotates together with the axle 6. As the arm 8 rotates, it pulls on the arm guide 9 and moves the arm guide 9 and at the same time the arm 8 slides in the arm guide 9. The arm guide 9 is mounted on the swing door leaf 400 and as the arm 8 moves the arm guide 9 the swing door leaf 400 will also move. When the axle 6 is rotated in the opposite direction it will move the guide arm 9 and the swing door leaf 400 in the opposite direction. In this manner the pull arm system 7 moves the swing door leaf 400 from the closed position to the open position and from the open position to the closed position. The length of the arm 8 and arm guide 9 and the position of the arm guide 9 on the swing door leaf 400 are set in relation to the position of the swing door operator 1 in relation to the swing door leaf 400 and the geometry of the swing door leaf 400.

Figure 5:
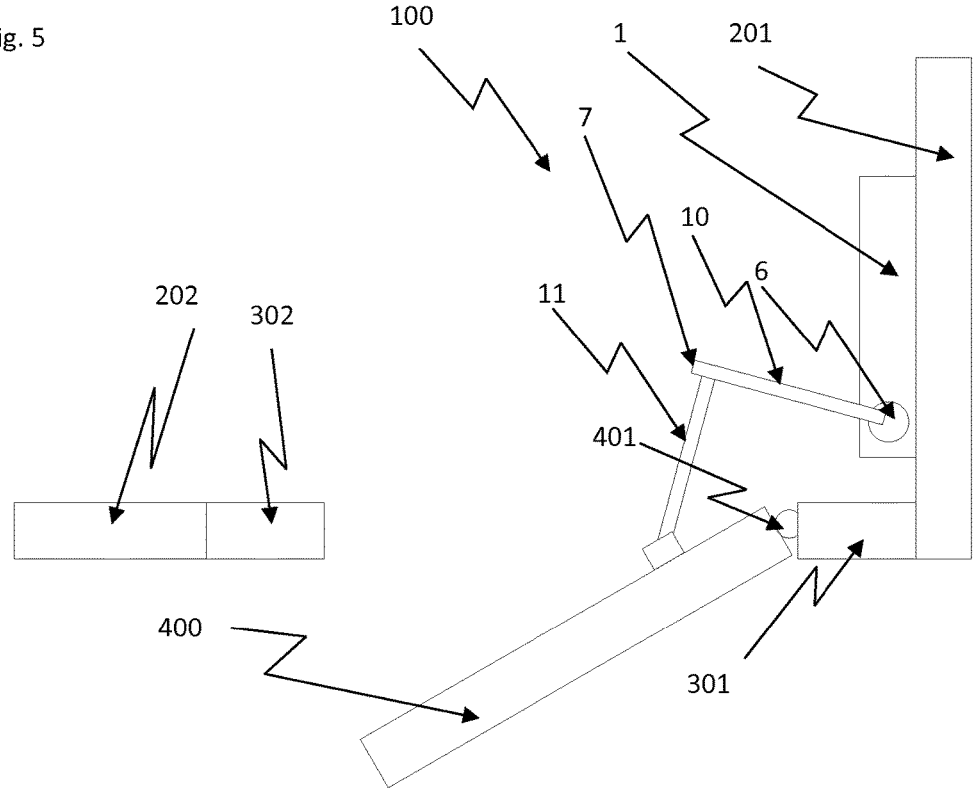
FIG. 5 shows a schematic top view of a fire swing door operator system comprising one corner mounted swing door operator for push application connected to a swing door leaf according to an aspect of the invention.
Figure 6:
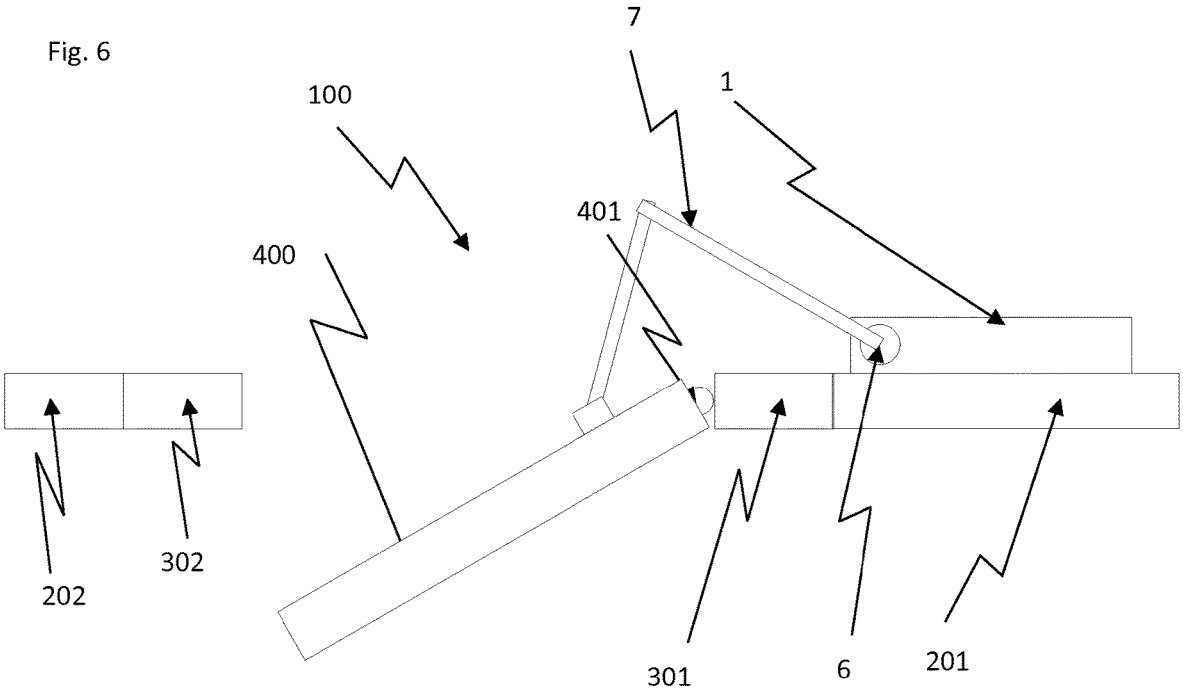
FIG. 6 shows a schematic top view of a fire swing door operator system comprising one side mounted swing door operator for push application connected to a swing door leaf according to an aspect of the invention.

The arm system 7 is according to an aspect a push arm system 7, as disclosed in FIGS. 5 and 6. The arm system is in one end connected to the axle 6. The arm system 7 is in its other end connected to the swing door leaf 400. The pull arm system 7 comprises a first arm 10 and a second arm 11. The first arm 10 is in one end connected to the axle 6. When the axle 6 is rotated the first arm 10 rotates together with the axle 6. The first arm 10 is in the other end rotatable connected to an end of the second arm 11. The second arm 11 is in the other end rotatable connected to the swing door leaf 400.

When the axle 6 is rotated by the drive unit 2, the first arm 10 rotates together with the axle 6. As the first arm 10 is rotated it pushes the second arm 11 to move. When the second arm 11 is moved by the first arm 10, it pushes on the swing door leaf 400 and moves it. When moved, the second arm 11 is rotated in relation to the first arm 10 and the swing door leaf 400. When the axle 6 is rotated in the opposite direction by the drive unit 2 it will move the first arm 10, the second arm 11 and the swing door leaf 400 in the opposite direction. In this manner the push arm system 7 moves the swing door leaf 400 from the closed position to the open position and from the open position to the closed position. The length of the first arm 10 and the second arm 11 and the position of where the second arm 11 is connected to the swing door leaf 400 are set in relation to the position of the swing door operator 1 in relation to the swing door leaf 400 and the geometry of the swing door leaf 400.

There are a number of geometries and features that has to be taken into account when the arm system 7 should be configured. One or more of the following aspects is taken into account, the side of the swing door leaf 400 that the swing door operator 1 is mounted, the distance from the axle 6 to the swing door leaf 400, the angle to which the swing door leaf 400 should be opened, the geometry of the swing door leaf 400, if the spring 4 should open or close the swing door leaf 400.

The wall 200 comprise a first wall section 201 at one side of the door frame 300 and a second wall section 202 at the other side of the door frame 300. The wall comprises an opening in which the door frame 300 is mounted. The first and second wall section 201, 202 is positioned on opposite sides of the door frame 300. Put in another way, the first and the second wall sections 201, 202 are positioned at a lateral side of the door frame 300. The first and/or second wall section 201, 202 could according to an aspect be located in direct contact with the door frame 300. According to an aspect the first and/or second wall sections 201, 202 are located at a distance from the door frame 300. Put in another way, there could be further wall sections between the door frame 300 and the first and the second wall sections 201, 202. The first and second wall sections 201, 202 are according to an aspect wall sections of a corner or a straight wall.

According to an aspect the wall 200 further comprises a third wall section 203 positioned above the door frame 300. According to an aspect there is no wall section above the door frame 300. According to an aspect the door frame 300 has the same height as the height of the first and the second wall sections 201, 202. Put in another way the door frame 300 has the same height as the position of the ceiling in the room.

By wall is meant any type of structure that surrounds the door frame 300 and that the door frame is connected to.

According to an aspect the door frame 300 comprise two vertical elements 301, 302 and a horizontal element 303 connecting the two vertical elements 301, 302. According to an aspect the swing door leaf 400 is hingedly connected by the hinge 401 to one of the vertical elements 301, 302, as disclosed in FIG. 4-7.

According to an aspect one swing door leaf 400 is hingedly connected to one of the vertical elements 301, 302 and the second swing door leaf 400 is hingedly connected the other vertical element 302, 301.

The swing door leaf 400 as such is known in the art and will thus not be described in detail herein.

If the third wall section 203 above the door frame 300 is large enough, the swing door operator 1 could be mounted on said third wall section 203. However, if the third wall section 203 is small, the door frame 300 is connected directly to the ceiling (i.e. there are no wall section above the door frame 300) or if the swing door leaf 400 is positioned close to a corner, as disclosed in FIGS. 4 and 5 the swing door operator 1 could not be mounted above the door frame 300 on the third wall section 203.

In FIG. 2 the swing door operator 1 is disclosed mounted to the first wall section 201 and connected to the swing door leaf 400 and arranged to move the at least one swing door leaf 400 between a closed and an open position. The swing door operator 1 is mounted on a height H1 that is smaller than the height H2 of the door frame. According to an aspect the swing door operator 1 is mounted on a height H1 that is smaller than the height H3 of the swing door leaf 400. The swing door operator is mounted with the axle 6 extending upwards. The arm system 7 is arranged above the drive unit 2 and connected to the axle 6 and to the swing door leaf 400. The swing door operator 1 is mounted such that the axle 6 is located as close to the rotating point of the swing door leaf 400 as possible. By having the axle 6 extending upwards the moving arm system 7 could be positioned as high as possible on the swing door leaf 400. This reduces the risk of a person or object passing through the door risks to come into contact with the moving arm system 7.

In FIG. 3 two swing door operator 1 connected to two swing door leafs 400 is disclosed. One swing door operator 1 is mounted to the first wall section 201 and connected to one swing door leaf 400 and arranged to move the at least one swing door leaf 400 between a closed and an open position. The other swing door operator 1 is mounted to the second wall section 202 and connected to the other swing door leaf 400 and arranged to move the swing door leaf 400 between a closed and an open position. The axle 6 of the two swing door operators 1 is directed upwards and connected to the arm system 7. Each arm system 7 is connected to a separate swing door leaf 400.

In FIG. 4 a fire swing door operator system according to an aspect is disclosed arranged in a pull application. The first wall section 201 and the second wall section 202 are the walls of a corridor. The door frame 300 is mounted to the first and second wall section 201, 202. The swing door operator 1 is mounted to the first wall section 201. The swing door operator 1 is mounted such that the axle 6 is directed upwards and such that the axle 6 is positioned at the door frame 300. The arm system 7 is a pull arm system 7 connected to the axle 6 at one end and to the swing door frame 400 at the other end. The geometries of the arm system 7, i.e. length of the arm 8 and the guide arm 9, is adapted to the position of the swing door operator 1, the position of the axle 6, the position of the guide arm 9 and the geometries of the swing door leaf 400. By arranging the swing door operator 1 on the first wall section 201 a swing door operator 1 could be used that not need to occupy a space above the door frame 300. The swing door operator 1 could be used together with door frames 300 that run all the way up to the ceiling or very close to the ceiling. The drive unit 2 rotates the axle 6 which in turn rotates the arm 8 that pulls the guide arm 9 and the swing door leaf 400 to the open position.

In FIG. 5 fire swing door operator system according to an aspect is disclosed arranged in a push application. The first wall section 201 and the second wall section 202 are arranged at an angle in view of each other to create a corner. The door frame 300 is mounted to the first and second wall section 201, 202. The swing door operator 1 is mounted to the first wall section 201. The swing door operator 1 is mounted such that the axle 6 is directed upwards and such that the axle 6 is positioned at the door frame 300. According to an aspect the axle 6 is positioned at the hinge 401. The arm system 7 is a push arm system 7. The first arm 10 is connected to the axle 6 and to the second arm 11. The second arm 11 is also connected to the swing door leaf 400. The geometries of the arm system 7, i.e. length of the first arm 10 and the second arm 11, is adapted to the position of the swing door operator 1, the position of the axle 6, the position that the second arm 11 is connected to the swing door leaf 400 and the geometries of the swing door leaf 400. By arranging the swing door operator 1 on the first wall section 201 the swing door operator 1 could be used that not need to occupy any space above the door frame 300. The swing door operator 1 could be used together with door frames 300 that run all the way up to the ceiling or very close to the ceiling.

In FIG. 6 fire swing door operator system according to an aspect is disclosed arranged in a push application. The first wall section 201 and the second wall section 202 are arranged parallel to each other, i.e. the first and second wall sections 201, 202 are parts of a straight wall. Put in another way, the first wall section 201 is parallel with the at least one swing door leaf 5 in its closed position. The door frame 300 is mounted to the first and second wall section 201, 202. The swing door operator 1 is mounted to the first wall section 201. The swing door operator 1 is mounted such that the axle 6 is directed upwards and such that the axle 6 is positioned at the door frame 300. According to an aspect the axle 6 is positioned at the hinge 401. The arm system 7 is a push arm system 7. The first arm 10 is connected to the axle 6 and to the second arm 11. The second arm 11 is also connected to the swing door leaf 400. The geometries of the arm system 7, i.e. length of the first arm 10 and the second arm 11, is adapted to the position of the swing door operator 1, the position of the axle 6, the position that the second arm 11 is connected to the swing door leaf 400 and the geometries of the swing door leaf 400. By arranging the swing door operator 1 on the first wall section 201 the swing door operator 1 could be used that not need to occupy space above the door frame 300. The swing door operator 1 could be used together with door frames 300 that run all the way up to the ceiling or very close to the ceiling.

In FIG. 7 fire swing door operator system according to an aspect is disclosed arranged in a pull application. The first wall section 201 and the second wall section 202 are arranged parallel to each other, i.e. the first and second wall sections 201, 202 are parts of a straight wall. One vertical element 301 of the door frame 300 is mounted to the first wall section 201 and the other vertical element 302 of the door frame 300 is mounted to the second wall section 202. The swing door operator 1 is mounted to the first wall section 201. The swing door operator 1 is mounted such that the axle 6 is directed upwards and such that the axle 6 is positioned at the door frame 300. According to an aspect the axle 6 is positioned at the hinge 401. The arm system 7 is a pull arm system 7 connected to the axle 6 at one end and to the swing door frame 400 at the other end. The geometries of the arm system 7, i.e. length of the arm 8 and the guide arm 9, is adapted to the position of the swing door operator 1, the position of the axle 6, the position of the guide arm 9 and the geometries of the swing door leaf 400. By arranging the swing door operator 1 on the first wall section 201 a swing door operator 1 could be used that not need to occupy space above the door frame 300. The swing door operator 1 could be used together with door frames 300 that run all the way up to the ceiling or very close to the ceiling. The drive unit 2 rotates the axle 6 which in turn rotates the arm 8 that pulls the guide arm 9 and the swing door leaf 400 to the open position.

According to an aspect the height H1 that the swing door operator 1 is mounted on is dependent on the height H2 of the door frame 300 and the height H3 of the swing door leaf 400.

According to an aspect the axle 6 of the swing door operator 1 is directed downwards.

According to an aspect the fire swing door operator system 100 comprise two swing door operators 1 and two swing door leafs 400 connected to the door frame 300. The first swing door operator 1 is mounted to the first wall section 201 and connected to the first swing door leaf 400 and arranged to move the first swing door leaf 400 between a closed and an open position. The second swing door operator 1 is mounted to the second wall section 202 and connected to the second swing door leaf 400 and arranged to move the second swing door leaf 400 between a closed and an open position.

In order to provide safe door leaf movement, one or several sensors or IR-curtains may be used in order to detect any obstacles located in the path of the door leaf. For a swing door set, the door operator is preferably connected to safety sensors arranged on the opening/closing edge of the swing door leaf.

In a swing door embodiment, the open position means that the swing door leaf 400 is opened to an angle $\alpha$ of approximately 80-110° in relation to the surrounding walls, which is a common door opening angle during regular use. The closed position means that the swing door leaf is arranged at a 0° angle, i.e. the door opening is completely closed by the swing door leaf.

The person skilled in the art realizes that the present invention by no means is limited to the preferred embodiments described above. On the contrary, many modifications and variations are possible within the scope of the appended claims.

The invention claimed is:

1. A fire swing door operator system comprising:

at least one swing door operator, a wall, a door frame, and at least one swing door leaf, wherein the at least one swing door operator includes a drive unit and an axle, the drive unit comprising a motor and a spring both connected to the axle;

the door frame is mounted on an opening in the wall;

the at least one swing door leaf is hingedly connected to the door frame;

the wall comprises a first wall section at one side of the door frame and a second wall section at another side of the door frame;

the at least one swing door operator is mounted to the first wall section and connected to the at least one swing door leaf, and arranged to move the at least one swing door leaf between a closed and an open position; and the spring is configured to exert a rotary force onto the axle to return the at least one swing door leaf to the closed or open position.

2. The fire swing door operator system according to claim 1, wherein the at least one swing door operator includes a control unit connected to the drive unit, wherein the motor and the spring are arranged to interact to move the at least one swing door leaf.

3. The fire swing door operator system according to claim 2, wherein the at least one swing door operator includes an arm system, the axle is connected to the drive unit and the arm system, and the arm system is further connected to the at least one swing door leaf, wherein the axle and the arm system are arranged to interact with the drive unit to move the at least one swing door leaf.

4. The fire swing door operator system according to claim 3, wherein the axle is rotated by the drive unit and extends upwards from the drive unit.

5. The fire swing door operator system according to claim 4, wherein the motor and the spring are positioned on one side of the axle in the swing door operator.

6. The fire swing door operator system according to claim 5, wherein the axle is positioned closer to the door frame than the motor and the spring.

7. The fire swing door operator system according to claim 4, wherein the spring is wound around the axle.

8. The fire swing door operator system according to claim 2, wherein the control unit is arranged to control a movement of the drive unit.

9. The fire swing door operator system according to claim 1, wherein the at least one swing door operator is arranged to push the at least one swing door leaf from the closed position to the open position.

10. The fire swing door operator system according to claim 1, wherein the at least one swing door operator is arranged to pull the at least one swing door leaf from the closed position to the open position.

11. The fire swing door operator system according to claim 1, wherein the first wall section is angled in view of the at least one swing door leaf in the closed position.

12. The fire swing door operator system according to claim 1, wherein the first and second wall sections are wall sections on separate sides of a corridor.

13. The fire swing door operator system according to claim 1, wherein the first and second wall sections are wall sections on separate sides of a corner.

14. The fire swing door operator system according to claim 1, wherein the first wall section is parallel with the at least one swing door leaf in the closed position.

15. The fire swing door operator system according to claim 1, further comprising a second swing door operator and a second swing door leaf connected to the door frame, wherein the second swing door operator is mounted to the second wall section and connected to the second swing door leaf and arranged to move the second swing door leaf between a closed and an open position.

16. The fire swing door operator system according to claim 1, wherein the at least one door operator is mounted at a height on the first or second wall section that is equal to or lower than a height of the door frame.

17. The fire swing door operator system according to claim 1, wherein the at least one swing door operator is mounted at a height on the first or second wall section that is equal to or lower than a height of the at least one swing door leaf.

18. The fire swing door operator system according to claim 1, wherein the door frame comprises two vertical elements and a horizontal element connecting the two vertical elements, and the at least one swing door leaf is hingedly connected to one of the vertical elements.

* * * * *